US005965337A

United States Patent [19]

Droin et al.

[11] Patent Number: 5,965,337

[45] Date of Patent: Oct. 12, 1999

[54] ELEMENT FOR INDUSTRIAL RADIOGRAPHY

[75] Inventors: Gerard Maurice Droin, Beaune; Gerard Amede Desire Friour, Chalon-Sur-Saone, both of France

[73] Assignee: Eastman Kodak Company, Rochester, N.Y.

[21] Appl. No.: 09/007,150

[22] Filed: Jan. 15, 1998

Related U.S. Application Data

[63] Continuation of application No. 08/682,975, Jul. 16, 1996, abandoned.

[30] Foreign Application Priority Data

Aug. 1, 1995 [FR] France ..... 9509555
Oct. 13, 1995 [FR] France ..... 9512457

[51] Int. Cl.[6] ..... G03C 1/035; G03C 5/17; G03C 5/30

[52] U.S. Cl. ..... 430/440; 430/567; 430/966

[58] Field of Search ..... 430/966, 567, 430/440

[56] References Cited

U.S. PATENT DOCUMENTS

| | | | |
|---|---|---|---|
| 4,177,071 | 12/1979 | DeBrabandere et al. | 430/494 |
| 4,414,304 | 11/1983 | Dickerson | 430/353 |
| 4,425,425 | 1/1984 | Abbott et al. | 430/502 |
| 4,883,748 | 11/1989 | Hayakawa | 430/567 |
| 5,028,518 | 7/1991 | Lyons et al. | 430/506 |
| 5,077,189 | 12/1991 | Cellone et al. | 430/567 |
| 5,230,993 | 7/1993 | Yamada et al. | 430/518 |
| 5,252,442 | 10/1993 | Dickerson et al. | 430/502 |
| 5,397,687 | 3/1995 | Willems et al. | 430/502 |
| 5,462,831 | 10/1995 | Jansen et al. | 430/139 |
| 5,472,834 | 12/1995 | Florens et al. | 430/523 |
| 5,620,836 | 4/1997 | Heremans et al. | 430/496 |
| 5,629,142 | 5/1997 | Maskasky | 430/502 |

FOREIGN PATENT DOCUMENTS

| | | | |
|---|---|---|---|
| 408213 | 1/1991 | European Pat. Off. | G03C 1/035 |
| 0 425 884 | 5/1991 | European Pat. Off. | G03C 1/34 |
| 0 538 947 | 4/1993 | European Pat. Off. | G03C 5/16 |
| 2367300 | 12/1976 | France | G03C 1/02 |

OTHER PUBLICATIONS

M. Dowd et al, "The Inherent Unsharpness of Radiographic Films" (Sep. 1976) vol. 18, No. 5, British Journal of Non–Destructive Testing, pp. 134–135.

*Primary Examiner*—Mark F. Huff
*Attorney, Agent, or Firm*—Carl O. Thomas

[57] ABSTRACT

A system for industrial radiography is disclosed comprised of (1) an industrial radiographic element comprised of a support covered on each of its major faces with a tabular grain emulsion layer in which at least 50 percent of total grain projected area is accounted for by silver bromide tabular grains having an average aspect ratio of at least 2 and a volume greater than 0.03 $\mu m^3$ and (2) disposed on opposite sides of the radiographic element, two intensifying screens designed to emit electrons when exposed to X or gamma rays with an energy greater than or equal to 10 kV. A speed improvement is realized upon exposure and processing.

15 Claims, No Drawings

ELEMENT FOR INDUSTRIAL RADIOGRAPHY

This is a continuation of U.S. Ser. No. 08/682,975, filed Jul. 16, 1996, now abandoned.

FIELD OF THE INVENTION

The present invention concerns an industrial radiographic system and a method of forming an industrial radiographic image using the system.

BACKGROUND

Industrial radiography is a non-destructive technique for testing and analyzing defects in components such as glass, paper, wood or metal parts. This technique is widely used in aeronautics, the nuclear industry or the petroleum industry since it makes it possible to detect welding defects or defects in the texture of materials in aircraft components, nuclear reactors or pipelines.

This technique consists of exposing a component to be analyzed to an ionizing radiation, in general X or gamma radiations having an energy between 10,000 and 15,000 kV, either directly or by means of an intensifying screen. It is therefore necessary with this technique to use specific radiographic elements which are sensitive to this ionizing radiation.

The sensitivity of the radiographic emulsions to X or gamma radiations is due to the absorption of a part of these radiations by the silver halide grains, which causes a secondary emission of electrons, which form an internal latent image. Consequently the ionization radiations have an action on the silver halide grains solely when they are absorbed by these grains.

However, it is known that the major part of the ionizing radiation passes through the silver halide grains without being absorbed. Only a very small part of the incident radiation (less than 1%) is absorbed and contributes to the formation of developable latent image nuclei.

It is for this reason that the elements for industrial radiography generally consist of silver halide emulsion comprising mainly thick grains (three dimensional or cubic) in order to be able to absorb the maximum amount of ionizing radiations passing through the emulsion layer.

In addition, in order to assist the absorption of the ionizing radiations, it is known that the silver content or the thickness of the emulsion layers can be increased, or that the radiographic support can be covered on each of its faces with a silver halide emulsion layer.

For example, the patent FR 2 367 300 describes a radiographic emulsion comprising silver halide grains having mean diameter of at least 0.25 $\mu$m and a substantially regular crystalline structure. In the examples illustrating this patent, the silver halide emulsions consist of regular cubo-octahedral grains of at least 0.7 1 $\mu$m.

For several years, there have appeared silver halide photographic elements consisting of tabular grains which offer sensitometric advantages such as, for example, an improved sensitivity/granularity ratio.

In more recent patents, attempts have therefore been made to introduce these tabular silver halide grains into industrial radiography elements.

For example, U.S. Pat. No. 5,230,993 describes a product for medical or industrial radiography which may contain tabular silver halide grains. However, as the examples show, this patent describes spectrally sensitized radiographic elements which are intended to be used with fluorescent intensifying screens which re-emit visible light when they are exposed to X-rays. In this case, the silver halide emulsions are conventional emulsions sensitive to visible light.

U.S. Pat. No. 4,883,748 describes a film for industrial radiography in which the silver halide emulsion comprises silver halide grains having an aspect ratio (the ratio between diameter and thickness) less than or equal to 5 (preferably between 1 and 3) and whose surface region contains a larger proportion of iodide than the internal region. In the examples illustrating the invention, the majority of the emulsions consist of tetradecahedral grains with an aspect ratio of 1. Example 2 shows clearly that by increasing the aspect ratio the contrast of the radiographic element exposed to X-rays is degraded.

SUMMARY OF THE INVENTION

In one aspect the present invention directed to an industrial radiographic element designed to be exposed to X or gamma radiations having an energy greater than or equal to 10 kV, which comprises a support covered on at least one face with a silver halide tabular grain emulsion layer in which at least 50 percent of total grain projected area is accounted for by tabular grains having an aspect ratio of at least 2.

In another aspect the invention is directed to a radiographic element as described above in which the support is covered on each of its major faces with a tabular grain silver halide emulsion layer, each of these layers being covered with a protective top layer.

In a further aspect the invention is directed to a system for industrial radiography comprised of a radiographic element as described in the preceding paragraph and, disposed on opposite sides of the radiographic element, two intensifying screens which emit electrons.

In an additional aspect the invention is directed to a method for forming an industrial radiographic image comprised of exposing a radiographic element as described above to X or gamma rays in order to form a latent image, and developing the latent image.

Most notably the invention improves sensitometric properties without any increase in the silver content. It is also compatible with ascorbic acid processing baths, which are known to be particularly advantageous from the ecological point of view. Other advantages of the invention can be appreciated from the following detailed description and examples.

DESCRIPTION OF PREFERRED EMBODIMENTS

A radiographic element is provided intended to be exposed to X or gamma radiations having an energy greater than or equal to 10 kV. The element comprises a support covered on at least one face with a silver halide tabular grain emulsion layer in which tabular grains account for at least 50 percent of total grain projected area and exhibit an aspect ratio of at least 2.

According to one embodiment, the volume of the tabular grains is greater than 0.02 $\mu m^3$ and, advantageously, the grain volume is greater than 0.03 $\mu m^3$ The radiographic clement of the invention can be exposed either directly or through an intensifying screen.

When the radiographic element of the invention is exposed to X or gamma rays, the sensitivity (speed) obtained is notably higher than that obtained with a radiographic element consisting of three-dimensional grains, for an identical grain volume. This remains true even when tabular grains are used having a high aspect ratio.

This result is all the more surprising because it might have been thought, according to the known prior art, that with tabular grains the absorption of X or gamma rays by the grains would be reduced.

In addition, with the radiographic element according to the invention, it is possible to use silver contents up to 25% lower than the silver contents of the emulsions with thick or three-dimensional grains of the elements for industrial radiography of the prior art, which also constitutes another surprising result.

Within the scope of the present invention, the term "tabular grains" refers to grains having two parallel faces wider than the other faces of the grain.

The aspect ratio (R) of a silver halide grain is the ratio of its equivalent circular diameter (ECD) to its thickness (e).

The term "silver halide tabular grain emulsion" indicates an emulsion in which at least 50% and preferably at least 80% of total grain projected area is accounted for by tabular grains having an aspect ratio greater than or equal to 2.

According to the invention, the tabular grains have a mean thickness below 0.5 $\mu$m and preferably below 0.2 $\mu$m. The average aspect ratio (R) of the tabular grains is preferably between 5 and 25. According to a preferred embodiment, the average aspect ratio of the tabular grains is between 10 and 20.

The tabular grains constituting the emulsion may be monodisperse or polydisperse, preferably monodisperse. The monodispersity of the grains is defined by the coefficient of variation (COV) which, expressed as a percentage, is equal to $(\tau/ECD)\times 100$, in which $\tau$ is the standard deviation of the grain population.

The preferred monodisperse emulsions have a COV less than or equal to 25% and preferably between 10 and 25%. According to one embodiment, the COV is between 14 and 21%.

These monodisperse tabular grain emulsions can, in one preferred form, be prepared according to the method described in Tsaur et al U.S. Pat. Nos. 5,147,771, 5,147,772, 5,147,773, 5,171,659 and 5,210,013.

The volume of the grains is measured using the ECD measurement and the thickness of the grains using the formula:

$$(\pi(ECD)^2/4)x\ e$$

the thickness being measured by effecting a carbon replica of the grain and measuring the length of the shadow. This measurement of the shadow is a conventional measurement which makes it possible to obtain an approximate value of the thickness of the grain in order to calculate the volume.

According to a preferred embodiment the volume of the grains is between 0.05 and 2 $\mu m^3$. According to one embodiment, when the radiographic element is intended to be exposed to high-energy radiation (above 500 kV), the volume of the tabular grains is preferably greater than 0.06 $\mu m^3$.

Preferably the tabular silver halide grains are comprised of at least 90 mole % bromide, based on total silver. In preferred forms these grains contain less than 5 mole % chloride or iodine, based on silver. According to a specifically preferred embodiment, the tabular grains are silver bromoiodide grains having a iodide content less than 3 mol %, based on silver. Iodide can be uniformly or non-uniformly distributed within the grains.

Tabular grains are described for example in Research Disclosure, September 1994, No 36544, Section I.B. (hereinafter referred to as *Research Disclosure*).

The methods of precipitating these tabular grains are known and are, for example, described in *Research Disclosure*, Section C.

The emulsions of the radiographic element of the present invention comprise the tabular grains as described above dispersed in a hydrophilic colloid such as gelatin, gelatin derivatives, albumin, a polyvinyl alcohol, polyvinyl polymers, etc.

The silver halide emulsions may contain doping agents, generally in small quantities, such as rhodium, indium, osmium, iridium ions etc (see Section I-D3 of *Research Disclosure*). These dopants are generally introduced during the precipitation of the emulsion.

The silver halide emulsions may be chemically sensitized in accordance with the methods described in the Section IV of *Research Disclosure*. The chemical sensitizes generally used are compounds of sulfur and/or selenium and gold. It is also possible to use sensitization by reduction.

The silver halide emulsions may contain, among other things, optical brighteners, anti-fogging compounds, surfactants, plasticizers, lubricants, hardening agents, stabilizers, or absorption and/or diffusion agents as described in Sections II-B, VI, VII, VIII and IX of *Research Disclosure*.

The radiographic element of the invention may comprise, in addition to the tabular grain emulsion layer as described above, other layers which are conventional in photographic elements such as protective layers (top coat), intermediate layers, filter layers or antihalo layers. The support can be any suitable support used for industrial radiography element. The conventional supports are polymer supports such as ethylene polyterephthalate. In the scope of the invention, the top layer itself can contain antistatic agents, polymers, matting agents, etc.

The support is preferably covered on both faces with a silver halide emulsion, at least one of the two emulsions being a tabular grain emulsion as described above. The emulsions situated on each side of the support may be identical or different in size, composition, silver content, etc.

According to a preferred embodiment, the support is covered on each face with a layer of tabular grain silver halide emulsion as described previously. According to the invention, the silver content of the radiographic element is between 50 mg/dm$^2$ and 200 mg/dm$^2$. This quantity can be distributed identically or otherwise between the two faces.

The radiographic elements of the invention may be hardened by means of hardening agents as described in *Research Disclosure*, Section II.B. These hardening agents may be organic or inorganic hardening agents such as chromium salts, aldehydes, N-methylol compounds, dioxane derivatives, compounds comprising active vinyl groups, compounds comprising active halogens, etc.

The radiographic element of the present invention may be used in a radiographic system consisting of two intensifying screens which do not emit visible light, disposed on each side of the radiographic element as defined above.

These intensifying screens are generally metal screens which enable the proportion of ionizing radiations absorbed by the silver halide grains to be increased. The X-rays interact with the intensifying screen, producing electrons in all directions. Some of these electrons will be absorbed by the silver halide grains in the emulsion layer in order to form latent image sites. By increasing the number of electrons emitted in the direction of the grains, the quantity of electrons absorbed by the grains is increased.

The screens normally used are sheets of lead, lead oxide, or dense metals such as copper or steel. The thickness of these screens is between 0.025 mm and 0.5 mm, depending on the type of ionizing radiation used.

The radiographic image is obtained by exposing, to X or gamma rays, either directly or through an intensifying screen, a radiographic element which comprises a support covered on at least one face with a layer of silver halide emulsion comprising tabular grains having an aspect ratio greater than or equal to 2 and a tabular grain volume greater than 0.03 $\mu m^3$, and by developing the exposed element using conventional processing methods or "ecological" processing methods, for example ascorbic acid processes. It is unnecessary to incorporate hardening agent in developer solution, since tabular grain emulsion layers can be fully forehardened without loss of covering power.

The processing methods for industrial radiography in general comprise a black and white developing bath containing a developer and a fixing bath comprising a solvent for silver halides such as thiosulfate, thiocyanate or sulfurated organic compounds. The conventional developers are in general dihydroxybenzene compounds, 3-pyrazolidone or aminophenol. In the "ecological" processing methods, the conventional developer is replaced with a more biodegradable compound such as ascorbic acid.

The present invention is illustrated by the following examples, which show the sensitometric advantages of the invention compared with the conventional radiographic elements.

EXAMPLES

The invention can be better appreciated by reference to the following specific embodiments. Although the Examples are written in the present tense, the examples are descriptions of actual as opposed to merely postulated undertakings.

Structure of the radiographic film

The radiographic films used in the following examples consist of an ESTAR® support covered on each face with a tabular grain emulsion layer with a silver content of 75 $mg/dm^2$ (total silver content 150 $mg/dm^2$). These emulsions are bromoiodide emulsions. The emulsion layer is covered with a protective layer consisting of gelatin containing as matting agents polymethyl-methacrylate beads (average size 4 $\mu m$) in an amount from 50 to 100 g per kg of gelatin. This protective layer also contains a copolymer consisting of polysiloxane (58%) and ethylene oxide (42%), a fluoropolymer Zonyl FSN® manufactured by DuPont and a lithium salt ($F_3CSO_3Li$).

The film is hardened with a quantity of bis (vinylsulfonylmethyl)ether equal to 1.5% by weight of a total dry gelatin contained in the element, providing a high hardening level.

The tabular grains represent more than 90% of the total number of grains constituting the emulsion.

The tabular character of the grains is determined by means of the aspect ratio R=ECD/e in which ECD is the equivalent circular diameter and e is the thickness of the grain. The grain volume is calculated by means of the formula $$(\pi(ECD)^2/4)x\ e$$

in which the thickness is obtained from the carbon replica of the grains.

The emulsion is monodisperse (COV=15%).

The emulsion is chemically sensitized to the optimum by means of sulfur and gold, the quantity of sulfur being between 30,000 and 50,000 At/$\mu m^2$ and the quantity of gold between 15,000 and 50,000 At/$\mu m^2$ (grain surface). At the end of the chemical sensitization, tetraazaindene is added to the emulsion (2 g/mol of silver).

EXAMPLE 1

A series of radiographic films is prepared in the format described above by making a silver halide emulsion according to the following method:

An approximately 1 $\mu m$ silver bromoiodide (1% iodide) emulsion was prepared by a double-jet precipitation technique utilizing accelerated flow.

To an aqueous gelatin solution (about 0.7 g/l) having a pH 3.5 and a pAg 10, was added a silver halide solvent (2 g of 2,2'-ethylenedithiodiethanol).

The volume was adjusted to 24 liters and 30° C.

With a constant stirring, were added by double-jet addition $AgNO_3$ (0.9 mol/l) and NaBr (0.9 mol/l) over a one minute period.

After a waiting period of 6 minutes, the temperature was raised to 65° C. over a 18 minute period.

At that time, 488 g of gelatin were added. Then, by double-jet addition, under stirring, a $AgNO_3$ solution (2.5 mol/l) and a NaBr, KI solution were added (final flow rate 18 time higher than the initial flow rate). pAg value was maintained constant and equal to 8.5.

The emulsion was then twice washed or ultrafiltrated.

The characteristics of the emulsions of each film are described in Table 1 below.

Each radiographic film is placed between two lead screens (25 $\mu m$) with a copper filtration of 8 mm, and then exposed to X-rays at a voltage of 220 kV and a current of 10 mA.

After exposure each element is developed with a Kodak MX800® process for industrial radiography (12 min., 27° C., dry to dry) which comprises a hardening development step with a hydroquinone phenidone developer (2.5 min.), a fixing step (2.5 min.), a washing step (2.5 min.) and a drying step.

The speed of the film is then measured for a density equal to $2+D_{SUPPORT}+D_{fog}$.

TABLE 1

| | AgX | ECD ($\mu m$) | e ($\mu m$) | Aspect ratio | Volume ($\mu m^3$) | Speed |
|---|---|---|---|---|---|---|
| 1.1- (Control) | AgBrI (1% I) | 0.5 | — | — | 0.065 | 100 |
| 1.2- (Inv.) | AgBr | 0.78 | 0.103 | 7.6 | 0.049 | 113 |
| 1.3- (Comp.) | AgBr | 0.6 | 0.08 | 7.5 | 0.023 | 99 |
| 1.4- (Inv.) | AgBrI (3% I) | 0.82 | 0.09 | 9.1 | 0.048 | 138 |
| 1.5- (Comp.) | AgBrI (1% I) | 0.93 | — | — | 0.421 | 116 |

The speed is a relative speed calculated from the speed of reference example 1.1 normalized to 100.

Examples 1.1 (Control) and 1.2 (Invention) show that, for the same grain volume, the emulsion containing the tabular grains has a speed greater than that obtained with three-dimensional grains. Example 1.3 (Comparative) shows that, for a volume less than half that of the control, a speed practically identical to that of the reference is obtained. It is therefore contemplated to use tabular grains having a grain volume of at least 0.03 $\mu m^3$. Example 1.4 (Invention), by comparison with example 1.2, shows that, for the same volume, the speed, within the scope of the invention, be increased by increasing the aspect ratio. Examples 1.2 (Invention) and 1.5 (Comparative) show that, in order to obtain speeds comparable with three-dimensional grains, a grain volume 10 times greater than the volume of the tabular grains is required.

These examples show that the increase in the volume of the tabular grains makes it possible to greatly increase the speed of the emulsion whilst the increase in the volume of the cubic grains affords only a very slight increase in speed.

EXAMPLE 2

In this example, a new series of photographic elements was prepared in accordance with the format and the preparation method described in example 1, in which the aspect ratio of the tabular grains was varied whilst maintaining a grain volume higher than 0.02 $\mu m^3$.

TABLE 2

| | AgX | ECD ($\mu$m) | e($\mu$m) | Shape factor | Volume ($\mu m^3$) | Speed |
|---|---|---|---|---|---|---|
| 2.1-(Comp.) | AgBrI (1% I) | 0.99 | — | 1 | 0.508 | 100 |
| 2.2-(Inv.) | AgBrI (3% I) | 0.83 | 0.14 | 5.9 | 0.076 | 124 |
| 2.3-(Inv.) | AgBrI (1% I) | 0.964 | 0.084 | 11.5 | 0.0613 | 114 |
| 2.4-(Inv.) | AgBrI (1% I) | 1.5 | 0.13 | 11.5 | 0.23 | 154 |
| 2.5-(Inv.) | AgBrI (1% I) | 1.5 | 0.096 | 15.6 | 0.170 | 140 |
| 2.6-(Inv.) | AgBrI (1% I) | 1.69 | 0.065 | 26.0 | 0.146 | 162 |

The speed is a relative speed calculated from the speed of comparative example 2.1 normalized to 100.

Examples 2.3 and 2.4 (Invention) show that, for the same aspect ratio, the increase in the volume of the grains enables the speed of the emulsion to be greatly increased.

EXAMPLE 3

In this example, a new series of radiographic films was prepared in accordance with the format described above. These radiographic elements were exposed to a source of Co 60.

The emulsion of example 3.1 (Control) is an emulsion consisting of polydisperse polymorphic grains of bromoiodide containing 1% iodide (uniform distribution of the iodide).

The emulsion of example 3.2 (Control) is a bromoiodide tabular grain emulsion containing 1% iodide (uniform distribution of the iodide). The sensitometric results are set out in Table 3 below.

TABLE 3

| | ECD ($\mu$m) | e($\mu$m) | Aspect ratio | Volume ($\mu m^3$) | Speed |
|---|---|---|---|---|---|
| Ex. 3.1 (Control) | 0.56 | — | — | 0.09 | 100 |
| Ex. 3.2 (Inv.) | 1.07 | 0.093 | 11.5 | 0.084 | 113 |

EXAMPLE 4

In this example, a new series of radiographic films was prepared in accordance with the format described above. The emulsions contained in these films were prepared according to the following preparation method. These emulsion comprised AgBrI tabular grains having locally a high iodide content (iodide peak), i.e., AgBrI tabular grains wherein the iodide repartition within the grain is non-uniform.

Preparation Method of AgBrI Tabular Grains Having a Iodide Peak

An approximately 1 $\mu$m silver bromoiodide (0.65% iodide) emulsion was prepared by a double-jet precipitation technique utilizing accelerated flow.

To an aqueous gelatin solution (about 0.7 g/l) having a pH 3.5 and a pAg 10, was added a silver halide solvent (2,8 g of 2,2-ethylenedithiodiethanol).

The volume was adjusted to 33 liters and 35° C.

With a constant stirring, were added by double-jet addition $AgNO_3$ (1.25 mol/l) and NaBr (1.25 mol/l) over a one minute period.

After a waiting period of 6 minutes, the temperature was raised to 65° C. over a 18 minute period.

At that time, 680 g of gelatin were added. Then, over a 43 minute period by double-jet addition, under stirring, a $AgNO_3$ solution (3 mol/l) and a NaBr solution were added (final flow rate 9 time higher than the initial flow rate). pAg value was maintained constant and equal to 8.5.

Then, iodide salt was added in one step. At this stage, double-jet addition of a $AgNO_3$ solution and a NaBr solution (3 mol/l) was repeated with a final flow 10 times higher than the initial flow for 15 minute, then with a constant flow for 18 minutes. The emulsion was then washed twice or ultrafiltrated.

The film of Example 4.1 was prepared from an emulsion prepared according to the method of Example 1 above.

The film of Example 4.2 comprises a bromoiodide (1% iodide) tabular grains prepared according to the above described preparation process. In this emulsion, iodide was added in one step after having added 64% of total silver.

Kink (pressure sensitivity) and speed were measured for each radiographic film. The kink was measured by exposing the radiographic film in order to obtain a density (Di) of 2, a pressure was then applied to the exposed area and the new density of the same area was measured ($D_P$). The values reported in Table 4 were (Dp/Di)×100=Dp/2)×100. The kink was considered all the more better since the values is near 100.

TABLE 4

| | ECD ($\mu$m) | e($\mu$m) | Aspect ratio | Volume ($\mu m^3$) | Kink | Speed |
|---|---|---|---|---|---|---|
| Ex. 4.1 | 1 | 0.10 | 10 | 0.078 | 110 | 100 |
| Ex. 4.2 | 1 | 0.10 | 10 | 0.078 | 97 | 113 |

An identical speed was obtained for the two radiographic films. The speed of the inventive industrial radiography films is not sensitive to the distribution of the iodide in the grain volume. However, when the emulsions comprised AgBrI tabular grains with a iodide peak, the kink is improved. Such a property is especially important for industrial radiographic films which are often manipulated without taking precautions.

EXAMPLE 5

In this example, the radiographic films described above were developed with the Kodak MX800® process of example 1. The same films were then developed on the one hand with the Kodak RA/30® developer where the developer is a mixture of hydroquinone and 1-phenyl-4,4-methylhydroxymethyl-3-pyrazolidone and which does not contain glutaraldehyde (hardening agent), and on the other hand with an ascorbic acid developer as described in *Research Disclosure* (August 1993, Article 35249) and which also does not contain any hardening agent.

There are set out in Tables 5 and 6 below the differences in speed and contrast obtained between the standard process and the RA/30® process (Table 5) and between the standard process and the ascorbic acid process (Table 6).

The film of examples 5.1 and 5.3 comprises, on each of these faces, an emulsion consisting of three-dimensional polydisperse polymorphic bromoiodide (1% iodide) grains (total silver content 200 mg/dm$^2$).

The film of examples 5.2 and 5.4 comprises, on each of these faces, an emulsion consisting of bromoiodide (1% iodide tabular grains (total silver content 150 mg/dm$^2$).

TABLE 5

Sensitometric differences between development in developer RA/30 ® and developer MX800 ®

| | ECD (μm) | e (μm) | Aspect ratio | Volume (μm$^3$) | Δ speed* | Δ contrast** |
|---|---|---|---|---|---|---|
| Ex. 5.1 | 0.52 | — | — | 0.074 | −1 | 0.47 |
| Ex. 5.2 | 1.07 | 0.085 | 12.6 | 0.076 | 7.4 | 0.19 |

*Differences in speed (as defined in example 1)

**Differences in contrast (wherein contrast slope between 2 density points $D_1$ and $D_2$ where $D_1 = 3.5 + D_{fog} + D_{support}$ and $D_2 = 1.5 + D_{fog} + D_{support}$).

TABLE 6

Sensitometric differences between development in ascorbic acid developer and MX8000 ® developer

| | ECD (μm) | e (μm) | Aspect ratio | Volume (μm$^3$) | Δ speed* | Δ contrast** |
|---|---|---|---|---|---|---|
| Ex. 5.3 | 0.52 | — | — | 0.074 | −8.5 | 0.15 |
| Ex. 5.4 | 1.07 | 0.085 | 12.6 | 0.076 | 4.9 | 0.09 |

These results show that, with the film of the present invention, the speed is maintained or increased whilst minimizing the impact on contrast when the processing method is changed. The radiographic films of the invention have better compatibility with existing processes.

The invention has been described in detail with particular reference to certain preferred embodiments thereof, but it will be understood that variations and modifications can be effected within the spirit and scope of the invention.

What is claimed is:

1. A system for industrial radiography comprised of (1) an X-ray sensitive radiographic element comprised of a support covered on each of its major faces with tabular grain emulsion layer in which at least 50 percent of total grain projected area is accounted for by silver bromide tabular grains containing at least 90 mol % bromide and having an average aspect ratio of at least 2 and a volume greater than 0.03 μm$^3$ and (2) disposed on opposite sides of the radiographic element, two intensifying metal screens designed to emit electrons when exposed to X or gamma rays with an energy greater than or equal to 10 kV.

2. A system for industrial radiography according to claim 1 in which the volume of the tabular grains is between 0.05 and 2 μm$^3$ and the aspect ratio is between 5 and 25.

3. A system for industrial radiography according to claim 2 in which the volume of the tabular grains is greater than or equal to 0.06 μm$^3$.

4. A system for industrial radiography according to claim 2 in which the tabular grains have an iodide content of 3 mole percent or less, based on silver.

5. A system for industrial radiography according to claim 1 in which the silver content of the radiographic element is between 50 and 200 mg/dm$^2$.

6. A system for industrial radiography according to claim 1 wherein the emulsion is free of spectral sensitizer dyes.

7. A system for industrial radiography comprised of (1) an industrial radiographic element comprised of a support covered on each of its major faces with a tabular grain emulsion layer in which at least 50 percent of total grain projected area is accounted for by silver bromoiodide tabular grains having a uniformly distributed iodide content of less than 5 mole percent, based on silver, having an average aspect ratio of at least 2, and having a volume greater than 0.03 μm$^3$, and (2) disposed on opposite sides of the radiographic element, two intensifying screens designed to emit electrons when exposed to X or gamma rays with an energy greater than or equal to 10 kV.

8. A system for industrial radiography according to claim 1 in which the volume of the tabular grains is between 0.05 and 2 μm$^3$ and the aspect ratio is between 5 and 25.

9. A system for industrial radiography according to claim 8 in which the volume of the tabular grains is greater than or equal to 0.06 μm$^3$.

10. A system for industrial radiography according to claim 7 in which the silver content of the radiographic element is between 50 and 200 mg/dm$^2$.

11. A system for industrial radiography according to claim 7 in which the tabular grains have an iodide content of 3 mole percent or less, based on silver.

12. A method for forming an industrial radiographic image comprised of exposing a system according to any one of claims 1 or 7 to X or gamma rays with an energy greater than or equal to 10 kV to form a latent image and developing the latent image.

13. A method according to claim 12 wherein the energy of the X or gamma rays is greater than or equal to 500 kV.

14. A method according to claim 12 wherein the latent image is developed in a developing bath which contains ascorbic acid as the developer.

15. A method according to claim 12 wherein the radiographic element is fully forehardened and the latent image is developed in a developing bath without further hardening.

* * * * *